US005562228A

United States Patent [19]

Ericson

[11] Patent Number: 5,562,228

[45] Date of Patent: Oct. 8, 1996

[54] COLLAPSIBLE COOLER APPARATUS

[76] Inventor: John C. Ericson, 4828 Hannibal Way, Las Vegas, Nev. 89130

[21] Appl. No.: 254,741

[22] Filed: Jun. 6, 1994

[51] Int. Cl.[6] ..... A45C 11/20; B65D 5/36; B65D 30/08; F25D 3/08

[52] U.S. Cl. ..... 220/415; 62/371; 62/457.7; 206/545; 206/546; 220/DIG. 10; 229/117.07; 383/110

[58] Field of Search ..... 220/6, 9.2, 9.1, 220/752, 467, DIG. 10; 383/110, 120; 206/541, 546, 549; 229/117.01, 117.07; 190/107; 62/457.1, 457.2, 457.7, 457.9, 371, 372, 530, 337

[56] References Cited

U.S. PATENT DOCUMENTS

| | | | |
|---|---|---|---|
| Des. 328,550 | 8/1992 | Mogil et al. . | |
| 880,347 | 2/1908 | Allgire | 220/9.2 |
| 1,696,138 | 12/1928 | Day et al. | 62/530 X |
| 2,519,960 | 8/1950 | Garton . | |
| 2,570,300 | 10/1951 | Acton | 62/457.7 |
| 3,262,283 | 7/1966 | Taylor . | |
| 3,319,684 | 5/1967 | Calhoun | 190/107 X |
| 3,387,650 | 6/1968 | Hoffman | 62/371 |
| 4,065,336 | 12/1977 | Conklin | 62/457.7 X |
| 4,311,022 | 1/1982 | Hall | 62/372 X |
| 4,537,313 | 8/1985 | Workman | 383/110 X |
| 4,892,226 | 1/1990 | Abathi | 62/371 X |
| 5,035,122 | 7/1991 | Oogjen . | |
| 5,076,711 | 12/1991 | Koehler, Jr. . | |
| 5,231,850 | 8/1993 | Morris . | |
| 5,361,603 | 11/1994 | Merrit-Munson | 62/530 X |
| 5,490,396 | 2/1996 | Morris | 62/457.2 |

*Primary Examiner*—Allan N. Shoap
*Assistant Examiner*—Niki M. Kopsidas

[57] ABSTRACT

A collapsible cooler apparatus includes a floor assembly which includes a quantity of a heat transfer material in a sealed floor module. A plurality of foldable wall assemblies are provided which include a lower wall subassembly, an upper wall subassembly, and an interior hinge connecting the lower wall subassembly to the upper wall subassembly. The lower wall subassemblies include respective quantities of a heat transfer material in respective sealed lower wall modules. The upper wall subassemblies include respective quantities of a heat transfer material in respective upper wall modules. A plurality of peripheral hinges are connected between the floor module and the lower wall subassemblies for securing the lower wall subassemblies to the floor assembly. Flexible corner panels are connected between adjacent foldable wall assemblies. A carry strap assembly which includes a first end is connected to one upper wall subassembly, and a second end of the carry strap assembly is connected to an opposite upper wall subassembly. A lid assembly is adapted to fit onto upper edges of the respective upper wall subassemblies. The lid assembly is adapted to fit onto the long edges of the upper wall subassemblies. A lid hinge is connected between the lid assembly and an upper wall subassembly. The lid assembly includes a handle. The lid assembly includes a quantity of a heat transfer material in a sealed lid module.

7 Claims, 3 Drawing Sheets

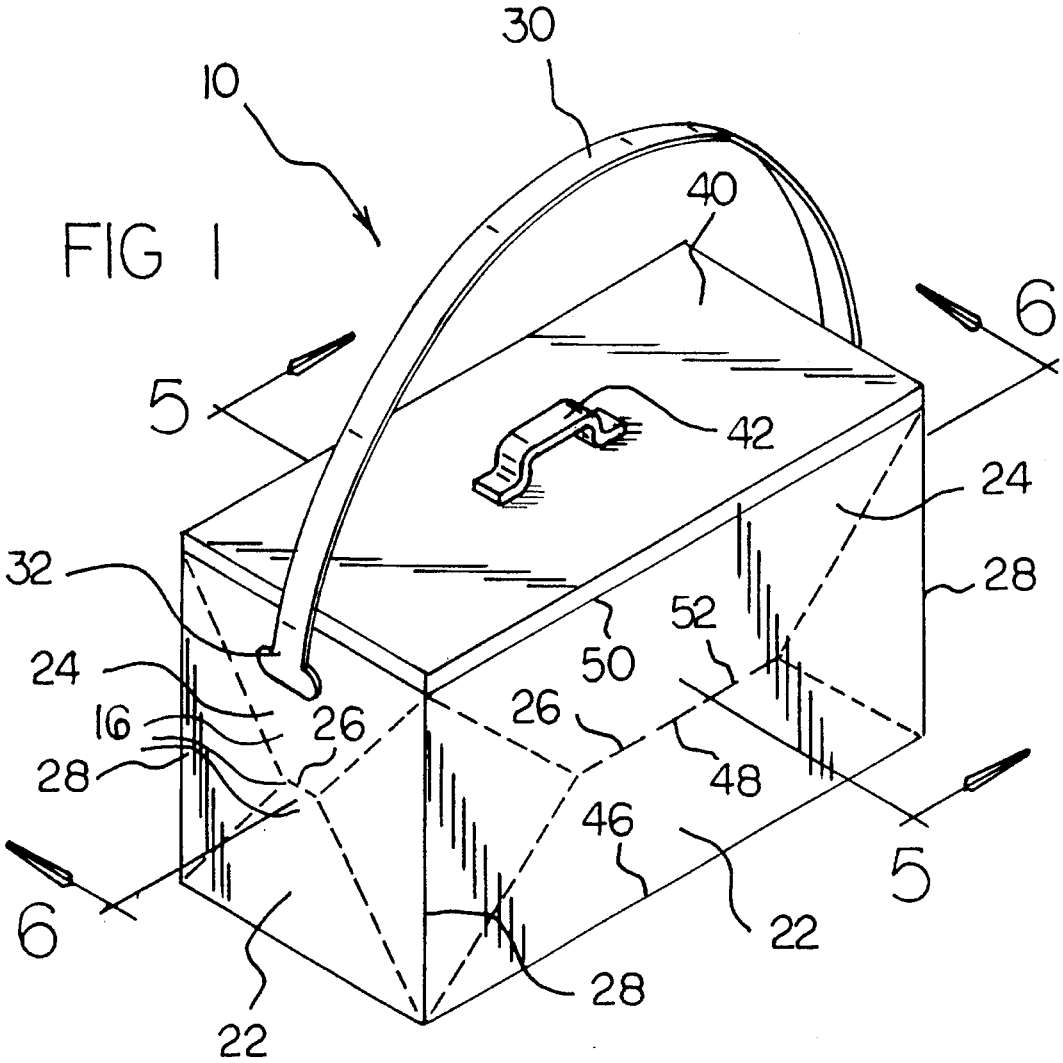
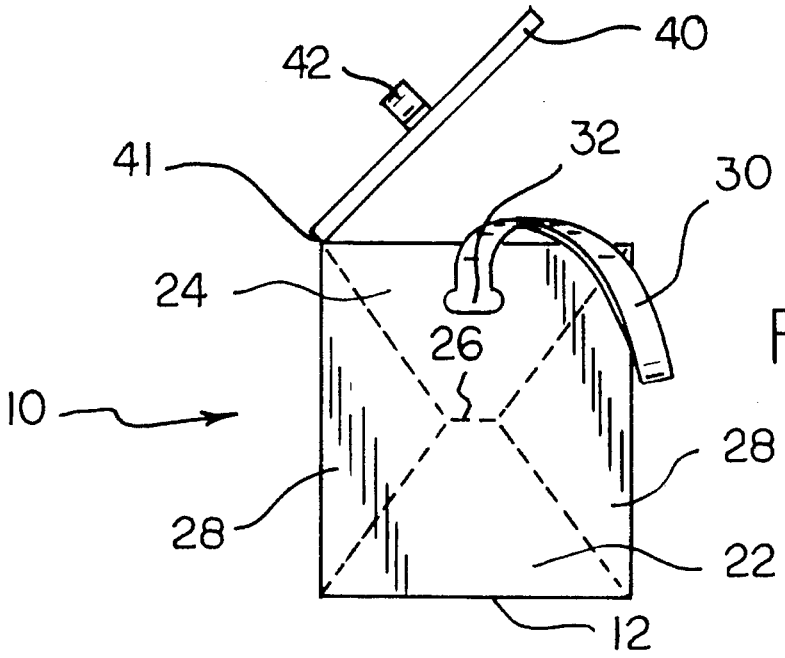
FIG 2

COLLAPSIBLE COOLER APPARATUS

BACKGROUND OF THE INVENTION

1. Field of the Invention

The present invention relates generally to portable coolers that can keep food and other perishables cool when away from a power source and, more particularly, to a portable cooler that can be collapsed to occupy a relatively small volume when the cooler is not in use.

2. Description of the Prior Art

Portable coolers are very useful devices for keeping food and other perishables cool when away from a source of electrical power. Often coolers are rigid structures that occupy substantially the same volume of space whether the cooler is in use or empty. For practical storage purposes, it would be desirable if a portable cooler would occupy less space when not in use than when actually in use.

The cooling medium often used for portable coolers is ice. A problem, however, associated with the use of ice is the liquid water that results from melted ice. The liquid water can penetrate into food containers if they are not provided with a water-fight seal, and very often they are not provided with such a seal. In this respect, it would be desirable if a portable cooler were provided with means for cooling stored items without using ice.

As an alternative to the use of ice for cooling in portable coolers, sealed modules containing special heat-transfer materials have been developed. Such heat-transfer materials include mixtures of glycols and water. Such glycol mixtures are referred the use of conventional water ice, it would be desired if a portable cooler employed sealed modules containing blue ice or the like.

Sealed modules containing blue ice are often placed in a home freezer compartment for a period of time, e.g. overnight, to allow the blue ice to freeze. A home freezer compartment is often used for a variety of purposes, and space therein is often very crowded. Thus, it would be desirable if a sealed module containing blue ice occupied a relatively small space in a freezer compartment.

Throughout the years, a number of innovations have been developed relating to portable coolers and collapsible containers, and the following U.S. patents are representative of some of those innovations: U.S. Pat. Nos. 2,519,960; 3,262,283; 5,035,122; 5,076,711; and 5,231,850. More specifically, U.S. Pat. No. 2,519,960 discloses a frozen food package in which blue ice is not employed.

U.S. Pat. No. 3,262,283 discloses a portable cooler that collapses for storage and that includes hollow walls in which a temperature modification medium is contained. More specifically, U.S. Pat. No. 3,262,283 discloses a non-folding floor, four walls, and a lid. The four walls are non-folding along the respective interior wall surfaces defined by the respective perimeters of the respective four walls. The non-folding walls are connected by hinges to the non-folding floor. Because of the non-folding nature of the four walls, when the device in U.S. Pat. No. 3,262,283 is collapsed for placement in a freezer, edges of the non-folding walls, which are adjacent to each other when the portable cooler is in a storage mode, are moved apart from one another, and the four non-folding walls are placed in the plane of the floor in the collapsed mode. To return the portable cooler to a storage mode, the four non-folding walls are lifted out of the plane of the floor of the device, and the edges of the four walls are placed adjacent to one another.

A significant disadvantage in using the portable cooler in U.S. Pat. No. 3,262,283 is the need to essentially disassemble the device to collapse the device for placement in a freezer and the need to essentially reassemble the device for placement in the storage mode.

U.S. Pat. No. 5,035,122 discloses a portable cooler that includes non-folding walls which include a freezable gel within wall interiors.

U.S. Pat. No. 5,076,711 discloses a collapsible, two-walled container for holding fish and ice. The walls of the container, though flexible, are not disclosed as folding along the respective interior wall surfaces defined by the respective perimeters of the respective walls.

U.S. Pat. No. 5,231,850 discloses a portable cooler that includes non-folding walls which include a refrigerant within wall interiors of the cooler.

Still other features would be desirable in a collapsible cooler apparatus. As mentioned above, it would be desirable to be able to interconvert a portable cooler from a collapsed mode to a storage mode without concomitant disassembly and reassembly. As a corollary, it would be desirable to be able to convert a portable cooler from a collapsed mode to a storage mode with a simple, one-handed pulling motion. In addition, it would be desirable to convert a portable cooler from a storage mode to a collapsed mode with a simple, one-handed pushing motion.

Thus, while the foregoing body of prior art indicates it to be well known to use portable coolers which collapse for storage, the prior art described above does not teach or suggest a collapsible cooler apparatus which has the following combination of desirable features: (1) occupies less space when not in use than when actually in use; (2) provides means for cooling stored items without using water ice; (3) employs sealed modules containing blue ice or the like; (4) provides sealed module containing blue ice which occupy a relatively small space in a freezer compartment; (5) avoids the need to essentially disassemble a device to collapse the device for placement in a freezer and avoids the need to essentially reassemble the device for placement in a storage mode; (6) enables conversion of a portable cooler from a collapsed mode to a storage mode with a simple, one-handed pulling motion; and (7) enables conversion of a portable cooler from a storage mode to a collapsed mode with a simple, one-handed pushing motion. The foregoing desired characteristics are provided by the unique collapsible cooler apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a collapsible cooler apparatus which includes a floor assembly which includes a quantity of a heat transfer material in a sealed floor module. A plurality of foldable wall assemblies are provided which include a lower wall subassembly, an upper wall subassembly, and an interior hinge connecting the lower wall subassembly to the upper wall subassembly. The lower wall subassemblies include respective quantifies of a heat transfer material in respective scaled lower wall modules. The upper wall subassemblies include respective quantities of a heat transfer material in respective upper wall modules. A plurality of peripheral hinges arc connected between the floor module and the lower wall subassemblies for securing the lower wall subassemblies to the floor assembly. Flexible corner panels arc connected between adjacent foldable wall assemblies. A carry strap assembly which includes a first end is connected to one upper wall subassembly, and a second end of the carry strap assembly is connected to an opposite upper wall subassembly.

A lid assembly is adapted to fit onto upper edges of the respective upper wall subassemblies. The lid assembly is adapted to fit onto the long edges of the upper wall subassemblies. A lid hinge is connected between the lid assembly and an upper wall subassembly. The lid assembly includes a handle. The lid assembly includes a quantity of a heat transfer material in a sealed lid module.

Preferably, the lower wall subassemblies are trapezoidal shaped and include a long edge and a short edge. The upper wall subassemblies are trapezoidal shaped and also include a long edge and a short edge. The long edges of the lower wall subassemblies are connected to the floor assembly. The short edges of the upper wall subassemblies are connected to the short edges of the lower wall subassemblies.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible cooler apparatus which has all of the advantages of the prior art and none of the disadvantages.

It is another object of the present invention to provide a new and improved collapsible cooler apparatus which may be easily and efficiently manufactured and marketed.

It is a further object of the present invention to provide a new and improved collapsible cooler apparatus which is of durable and reliable construction.

An even further object of the present invention is to provide a new and improved collapsible cooler apparatus which is susceptible of a low cost of manufacture with regard to both materials and labor, and which accordingly is then susceptible of low prices of sale to the consuming public, thereby making such collapsible cooler apparatus available to the buying public.

Still yet a further object of the present invention is to provide a new and improved collapsible cooler apparatus which occupies less space when not in use than when actually in use.

Still another object of the present invention is to provide a new and improved collapsible cooler apparatus that provides means for cooling stored items without using water ice.

Yet another object of the present invention is to provide a new and improved collapsible cooler apparatus which employs sealed modules containing blue ice or the like.

Even another object of the present invention is to provide a new and improved collapsible cooler apparatus that provides sealed module containing blue ice which occupy a relatively small space in a freezer compartment.

Still a further object of the present invention is to provide a new and improved collapsible cooler apparatus which avoids the need to essentially disassemble a device to collapse the device for placement in a freezer and avoids the need to essentially reassemble the device for placement in a storage mode.

Yet another object of the present invention is to provide a new and improved collapsible cooler apparatus that enables conversion of a portable cooler from a collapsed mode to a storage mode with a simple, one-handed pulling motion.

Still another object of the present invention is to provide a new and improved collapsible cooler apparatus which enables conversion of a portable cooler from a storage mode to a collapsed mode with a simple, one-handed pushing motion.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the collapsible cooler apparatus of the invention in a storage mode.

FIG. 2 is a side view of the embodiment of the collapsible cooler apparatus shown in FIG. 1 with the lid lifted.

DESCRIPTION OF THE PREFERRED EMBODIMENT

Figures 3, 4:
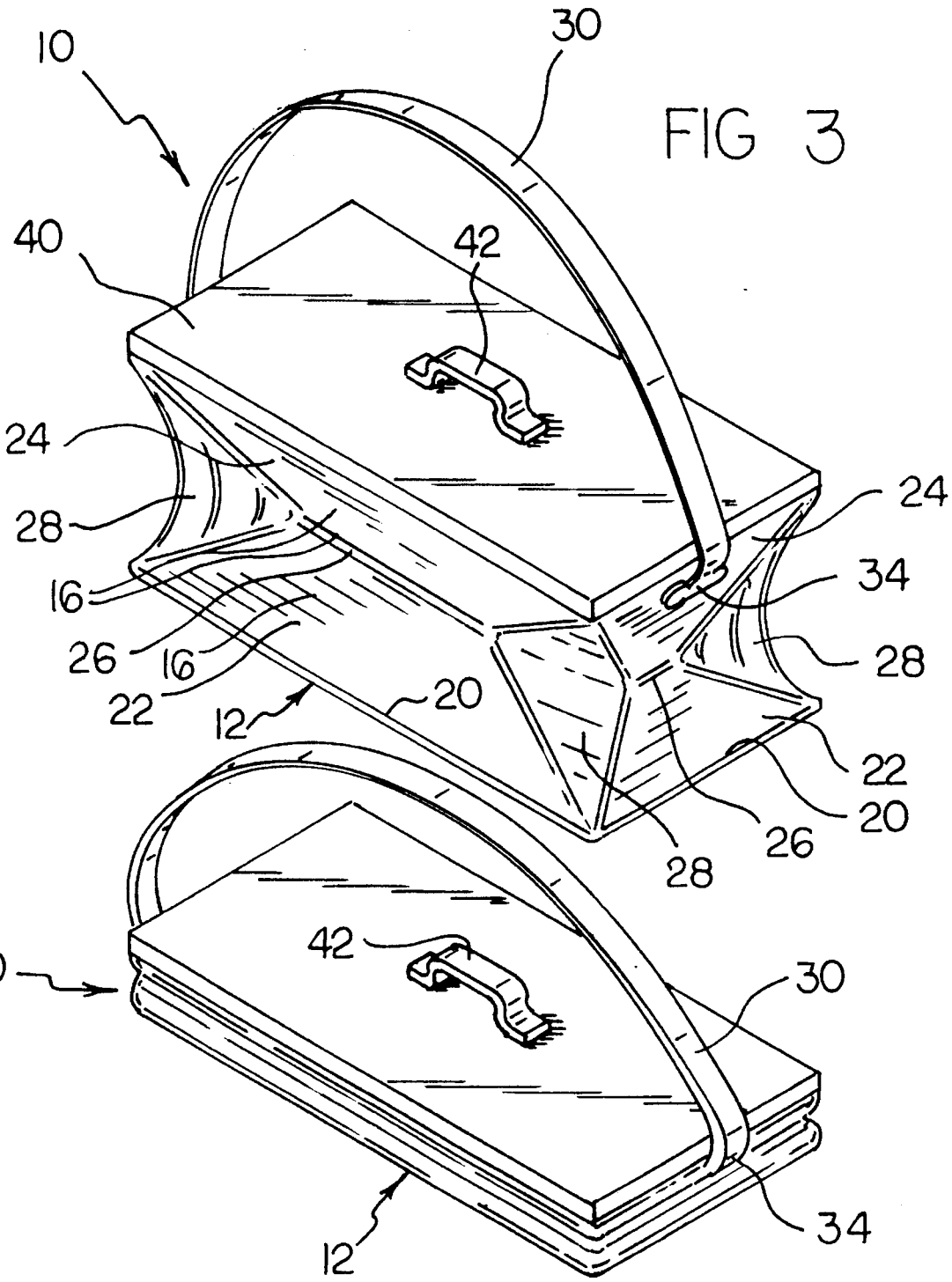
FIG. 3 is a perspective view of the embodiment of the collapsible cooler apparatus of FIG. 1 in a partially collapsed condition.
FIG. 4 is a perspective view of the embodiment of the invention shown in FIG. 3 in a fully collapsed mode.
Figure 5:
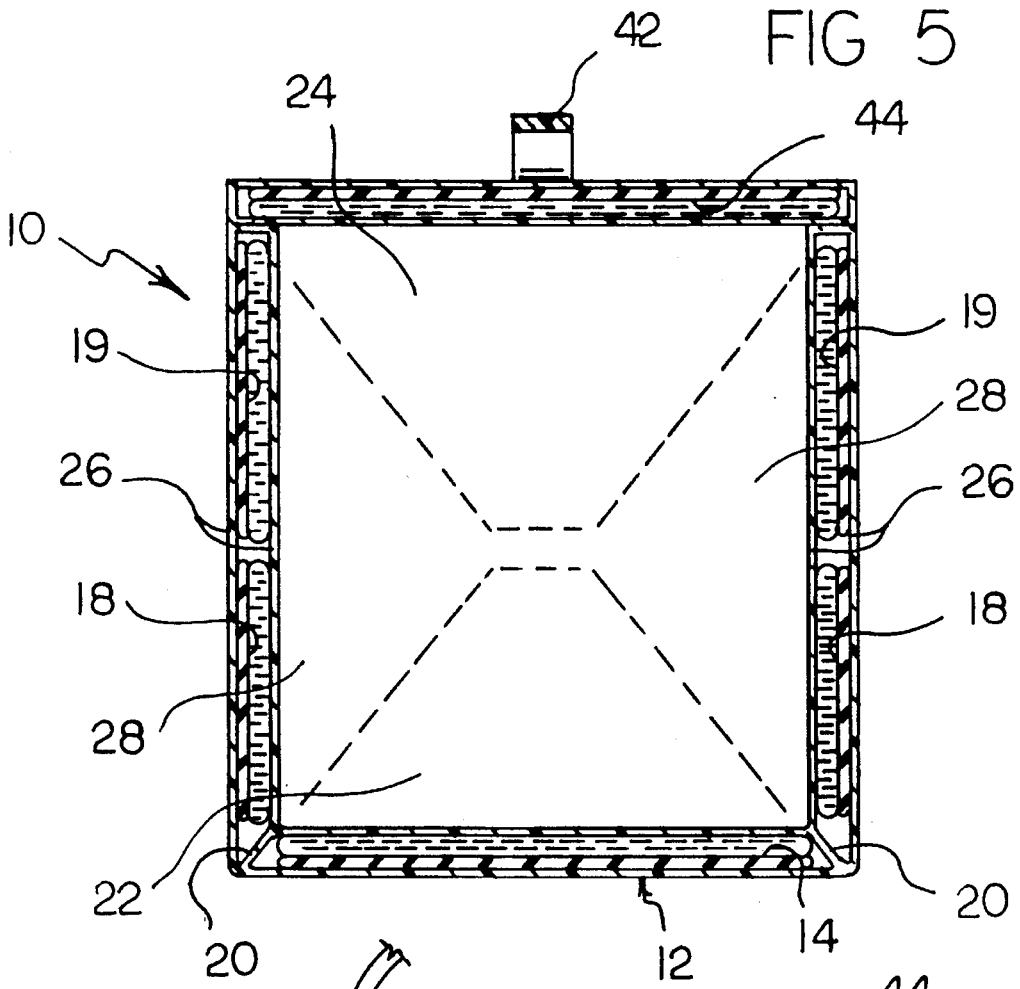
FIG. 5 is an enlarged cross-sectional view of the embodiment of the invention shown in FIG. 1 taken along line 5—5 of FIG. 1.
Figure 6:
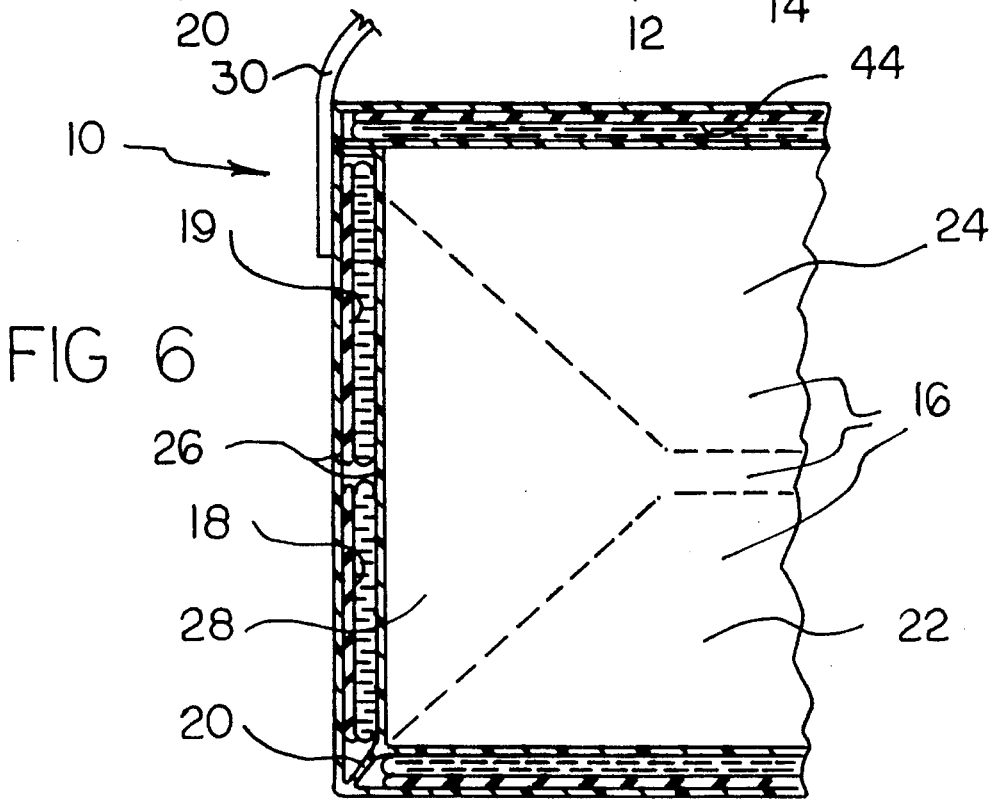
FIG. 6 is an enlarged cross-sectional view of the embodiment of the invention shown in FIG. 1 taken along line 6—6 of FIG. 1.

With reference to the drawings, a new and improved collapsible cooler apparatus embodying the principles and concepts of the present invention will be described.

Turning to FIGS. 1–6, there is shown an exemplary embodiment of the collapsible cooler apparatus of the invention generally designated by reference numeral 10. In its preferred form, collapsible cooler apparatus 10 includes a floor assembly 12 which includes a quantity of a heat transfer material in a sealed floor module 14. A plurality of foldable wall assemblies 16 are provided which include a lower wall subassembly 22, an upper wall subassembly 24, and an interior hinge 26 connecting the lower wall subassembly 22 to the upper wall subassembly 24. The lower wall subassemblies 22 include respective quantities of a heat transfer material in respective sealed lower wall modules 18. The upper wall subassemblies 24 include respective quantities of a heat transfer material in respective upper wall modules 19. A plurality of peripheral hinges 20 are connected between the floor module 14 and the lower wall subassemblies 22 for securing the lower wall subassemblies 22 to the floor assembly 12. Flexible corner panels 28 are connected between adjacent foldable wall assemblies 16. A carry strap assembly 30 which includes a first end 32 is connected to one upper wall subassembly 24, and a second end 34 of the carry strap assembly 30 is connected to an opposite upper wall subassembly 24.

When the collapsible cooler apparatus 10 of the invention is in a completely collapsed mode, as shown in FIG. 4, the collapsible cooler apparatus 10 is moved to a partially collapsed mode, as shown in FIG. 3, and to a fully expanded storage mode as shown in FIG. 1 by a person pulling up with one hand on the carry strap assembly 30.

A lid assembly 40 is adapted to fit onto upper edges of the respective upper wall subassemblies 24. The lid assembly 40 is adapted to fit onto the long edges 50 of the upper wall subassemblies 24. A lid hinge 41 is connected between the lid assembly 40 and an upper wall subassembly 24. The lid assembly 40 includes a handle 42. The lid assembly 40 includes a quantity of a heat transfer material in a sealed lid module 44.

To reverse the collapsible cooler apparatus 10 of the invention back to the fully collapsed mode, with all items removed from the collapsible cooler apparatus 10, the person simply presses down with one hand on the lid assembly 40.

Preferably, the lower wall subassemblies 22 are trapezoidal shaped and include a long edge 46 and a short edge 48. The upper wall subassemblies 24 are trapezoidal shaped and also include a long edge 50 and a short edge 52. The long edges 46 of the lower wall subassemblies 22 are connected to the floor assembly 12. The short edges 52 of the upper wall subassemblies 24 are connected to the short edges 48 of the lower wall subassemblies 22.

The heat transfer material can be selected from a variety of materials which include, for example, blue ice, mixtures of glycol and water, and the heat transfer materials disclosed in U.S. Pat. Nos. 3,262,283, 5,035,122, and 5,231,850, discussed hereinabove and incorporated herein by reference.

The hinges used for connecting the lower wall subassemblies 22 to the floor assembly 12, the upper wall subassemblies 24 to the lower wall subassemblies 22, and the lid assembly 40 to an upper wall subassembly 24 can be made from thin sheets of flexible plastic such as commonly employed in a "living hinge". The floor assembly 12 and the foldable wall assemblies 16 can be covered with plastic sheet material such as vinyl plastic. If desired, a zipper can be provided for connecting the lid assembly 40 to upper wall subassemblies 24. In addition, the corner panels 28 can be made from flexible vinyl plastic materials. In selecting hinge materials for various embodiments of the collapsible cooler apparatus 10 of the invention, it is important to keep in mind that the hinge should operate effectively at very cold temperatures. If desired, mechanical hinges, such as those including a hinge pin, can be employed instead of flexible plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved collapsible cooler apparatus that is low in cost, relatively simple in design and operation, and which may advantageously be used to occupy less space when not in use than when actually in use. With the invention, a collapsible cooler apparatus provides means for cooling stored items without using water ice. With the invention, a collapsible cooler apparatus is provided which employs sealed modules containing blue ice or the like. With the invention, a collapsible cooler apparatus provides sealed module containing blue ice which occupy a relatively small space in a freezer compartment. With the invention, a collapsible cooler apparatus is provided which avoids the need to essentially disassemble a device to collapse the device for placement in a freezer and avoids the need to essentially reassemble the device for placement in a storage mode. With the invention, a collapsible cooler apparatus is provided which enables conversion of a portable cooler from a collapsed mode to a storage mode with a simple, one-handed pulling motion. With the invention, a collapsible cooler apparatus is provided which enables conversion of a portable cooler from a storage mode to a collapsed mode with a simple, one-handed pushing motion.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A collapsible cooler apparatus, comprising:

a floor assembly which includes a quantity of a heat transfer material in a sealed floor module, a plurality of foldable wall assemblies which include a lower wall subassembly, an upper wall subassembly, and an interior hinge connecting said lower wall subassembly to said upper wall subassembly, wherein said lower wall subassemblies include respective quantities of a heat transfer material in respective sealed independent lower wall modules contained in said lower wall subassemblies, wherein said upper wall subassemblies include respective quantities of a heat transfer material in respective sealed independent upper wall modules contained in said upper wall subassemblies, a plurality of peripheral hinges connected between said floor module and said lower wall subassemblies, and flexible corner panels connected between adjacent foldable wall assemblies.

2. The apparatus of claim 1, further including:

a carry strap assembly which includes a first end connected to one upper wall subassembly, and a second end connected to an opposite upper wail subassembly.

3. The apparatus of claim 1, further including:

a lid assembly including straight edges adapted to fit onto upper straight edges of said respective upper wall subassemblies.

4. The apparatus of claim 3 wherein:

said lower wall subassemblies are trapezoidal shaped and include a straight long edge and a straight short edge, said upper wall subassemblies are trapezoidal shaped and include a straight long edge and a straight short edge, said straight long edges of said lower wall subassemblies are connected to said floor assembly, said straight short edges of said upper wall subassemblies are connected to said straight short edges of said lower wall subassemblies, and said lid assembly includes straight edges adapted to fit onto said straight long edges of said upper wall subassemblies.

5. The apparatus of claim 3, further including:

a lid hinge connected between said lid assembly and an upper wall subassembly.

6. The apparatus of claim 3 wherein said lid assembly includes a handle.

7. The apparatus of claim 3 wherein said lid assembly includes a quantity of a heat transfer material in a sealed lid module.

* * * * *